US008109215B2

(12) United States Patent
Kitada et al.

(10) Patent No.: US 8,109,215 B2
(45) Date of Patent: Feb. 7, 2012

(54) DESK TOP PANEL AND A DESK WITH THE SAME

(75) Inventors: Kazuhiko Kitada, Yokohama (JP); Osamu Nozaki, Higashiosaka (JP)

(73) Assignee: Okamura Corporation (JP)

( * ) Notice: Subject to any disclaimer, the term of this patent is extended or adjusted under 35 U.S.C. 154(b) by 258 days.

(21) Appl. No.: 12/513,778

(22) PCT Filed: Nov. 6, 2007

(86) PCT No.: PCT/JP2007/071511

§ 371 (c)(1),
(2), (4) Date: May 6, 2009

(87) PCT Pub. No.: WO2008/056640

PCT Pub. Date: May 15, 2008

(65) Prior Publication Data

US 2010/0024688 A1 Feb. 4, 2010

(30) Foreign Application Priority Data

Nov. 9, 2006 (JP) ..... 2006-304225
Nov. 9, 2006 (JP) ..... 2006-304226

(51) Int. Cl.
*A47B 37/00* (2006.01)

(52) U.S. Cl. ..... 108/50.02; 312/196; 312/223.6; 52/239

(58) Field of Classification Search .... 108/50.01–50.02; 312/194–196, 223.3, 223.6; 52/36.1, 220.7, 52/239

See application file for complete search history.

(56) References Cited

U.S. PATENT DOCUMENTS 5,038,539 A * 8/1991 Kelley et al. ..... 52/239
(Continued)

FOREIGN PATENT DOCUMENTS

JP 3-98634 10/1991
(Continued)

OTHER PUBLICATIONS

International Search Report dated Feb. 12, 2008, issued in corresponding international application No. PCT/JP2007/074511.

(Continued)

*Primary Examiner* — Hanh V Tran
(74) *Attorney, Agent, or Firm* — Ostrolenk Faber LLP

(57) ABSTRACT

Provided is a desk top panel, which normally protects privacy in a complete shielding form, permits facing persons to converse and documents and the like to be passed and received by opening a lower space of the desk top panel as needed, and permits a wiring cover to be easily attached/removed or opened/closed. A desk having such desk top panel attached thereon is also provided. A desk top panel is attached to the rear portion of a top board of a desk to stand, for blocking the visual fields of sitting persons. The desk top panel is provided with a panel-like main body; a pair of right and left attaching sections, which vertically extend downward from the both lower end portions of the main body by having the lower end sections attached to the top board or a top board supporting body of the desk; and a closing plate, attached to the lower end of the main body to be opened/closed, so that a space formed between the main body and the upper surface of the top board of the desk can be opened/closed when both the attaching sections are attached to the desk.

11 Claims, 10 Drawing Sheets

U.S. PATENT DOCUMENTS

| | | | | |
|---|---|---|---|---|
| 5,172,529 | A * | 12/1992 | Van De Riet | 52/220.7 |
| 5,277,005 | A * | 1/1994 | Hellwig et al. | 52/220.1 |
| 5,901,513 | A * | 5/1999 | Mollenkopf et al. | 52/220.7 |
| 6,446,396 | B1 * | 9/2002 | Marangoni et al. | 52/36.1 |
| 6,567,335 | B1 * | 5/2003 | Norman et al. | 365/230.06 |
| 6,725,784 | B2 * | 4/2004 | Crinion | 108/64 |
| 6,792,877 | B2 * | 9/2004 | Gutgsell et al. | 108/50.02 |
| 7,041,897 | B2 * | 5/2006 | Herzog | 174/500 |
| 2003/0136313 | A1 * | 7/2003 | Griepentrog | 108/50.02 |
| 2005/0268823 | A1 * | 12/2005 | Bakker et al. | 108/50.02 |

FOREIGN PATENT DOCUMENTS

| | | | |
|---|---|---|---|
| JP | 3-98634 | U | 10/1991 |
| JP | 4-46588 | Y2 | 11/1992 |
| JP | 5-22 | Y | 1/1993 |
| JP | 11266935 | * | 10/1999 |
| JP | 2000-287758 | | 10/2000 |
| JP | 2004-313471 | | 11/2004 |
| JP | 2005-81096 | | 3/2005 |
| JP | 2005-102739 | A | 4/2005 |
| JP | 2006-6771 | | 1/2006 |
| JP | 2006-149554 | | 6/2006 |
| JP | 2006-239013 | | 9/2006 |

OTHER PUBLICATIONS

Office Action dated Sep. 8, 2011 issued in corresponding Japanese Patent Application No. 2006-304225 with English translation (3 pages).

Office Action dated Sep. 8, 2011 issued in corresponding Japanese Patent Application No. 2006-304226 with English translation (5 pages).

* cited by examiner

DESK TOP PANEL AND A DESK WITH THE SAME

CROSS REFERENCE TO RELATED APPLICATIONS

The present application is a 35 U.S.C. §371 National Phase conversion of PCT/JP2007/071511, filed Nov. 6, 2007, which claims benefit of Japanese Application No. 2006-304225, filed Nov. 9, 2006 and Japanese Application No. 2006-304226, filed Nov. 9, 2006, the disclosures of which are incorporated herein by reference. The PCT International Application was published in the Japanese language.

BACKGROUND OF THE INVENTION

The present invention relates to a desk top panel on the upper surface of a top board of a desk to block visibility of a person and a desk with the desk top panel.

Such a desk top panel is a perfectly-partitioned type as disclosed in JP2004-313471A. There is also a desk top panel where only upper part is partitioned and lower part comprises only posts for supporting the upper part to create openings between the posts.

JP2006-6771A discloses a wire storage space under a desk top panel.

Furthermore, JP3-98634U, JP2000-287758A and JP2006-149554A disclose an opening in a top board of a desk, wires for lighting instruments on the top board and electronic equipment being introduced to a wire duct through the opening, the opening being closed by a wire cover.

In JP2004-313471A, privacy of face-to-face persons who sit in front of the desk or table can be protected with the partitioning desk top panel, but one has to walk around the corner of the desk or table when one need talk to the other or give documents.

The lower-part open type provides advantage contrary to the above, but it is possible to see through the lower space, so that one's privacy is invaded.

In JP2006-6771A, a wire storage space is formed beside the desk top panel in the top board, so that an effective working area on the top board is reduced.

In JP3-98634U, JP2000-287758A and JP2006-149554A, when the desk top panel is mounted, the wire cover may be obstructed from opening/closing and taking on/off, and wiring will become more difficult.

When the wire opening is along the desk top panel, a working space is reduced, so that the top board will be less effective in use.

SUMMARY OF THE INVENTION

In view of the disadvantages, it is an object of the invention to provide a desk top panel and a desk with the desk top panel, the desk being normally partitioned by a desk top panel to protect privacy, lower part of the desk top panel being opened, if necessary, to enable face-to-face persons to talk with each other and to give/receive documents, a wire cover being easily removed or opened.

It is another object of the invention to provide a desk top panel having a wire storage space under a desk top panel without reducing effective working area on a top board of the desk.

DETAILED DESCRIPTION OF PREFERRED EMBODIMENTS

Figure 1:
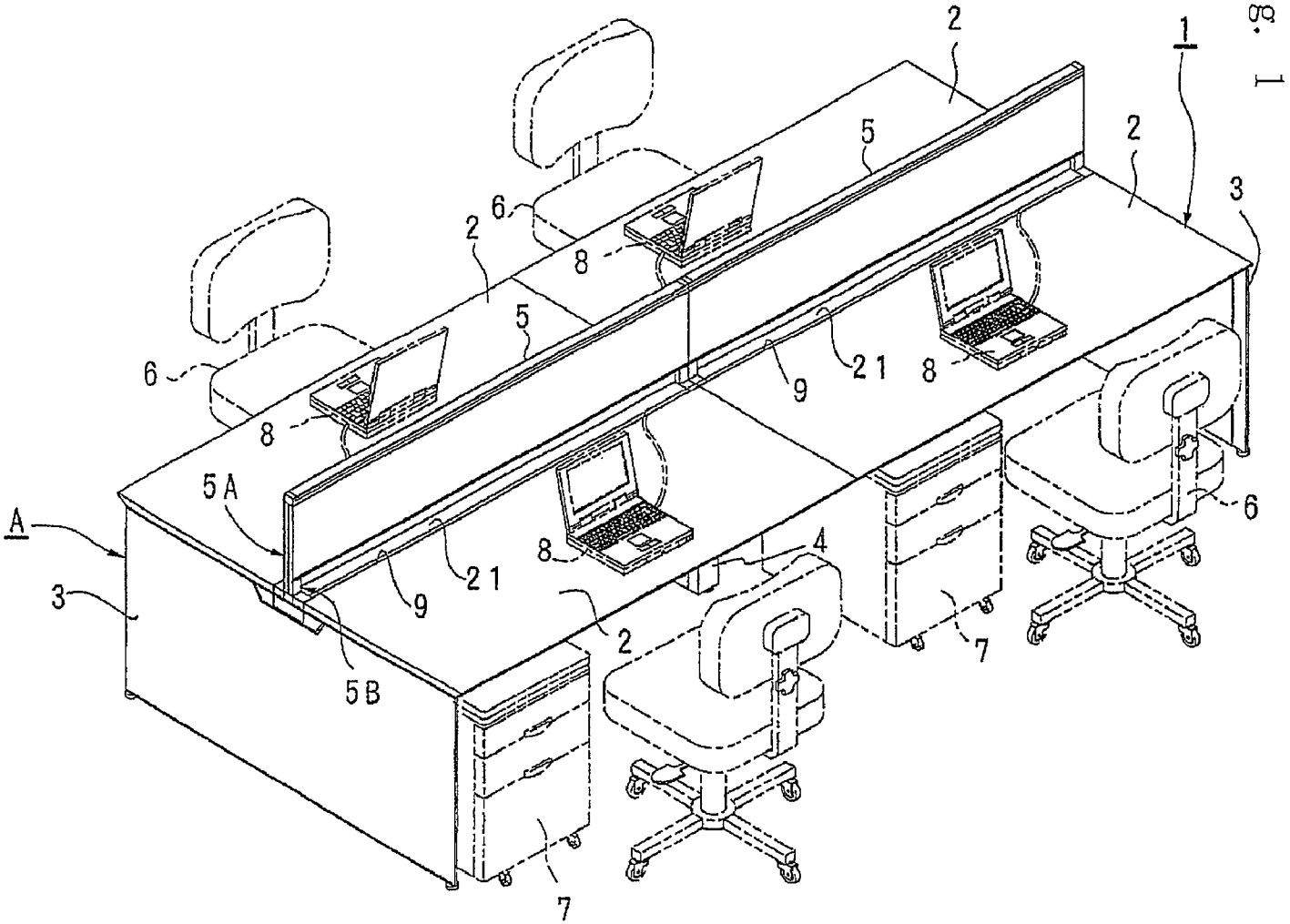
FIG. 1 is a perspective view showing a desk with the first embodiment of a desk top panel according to the present invention.
Figure 2:
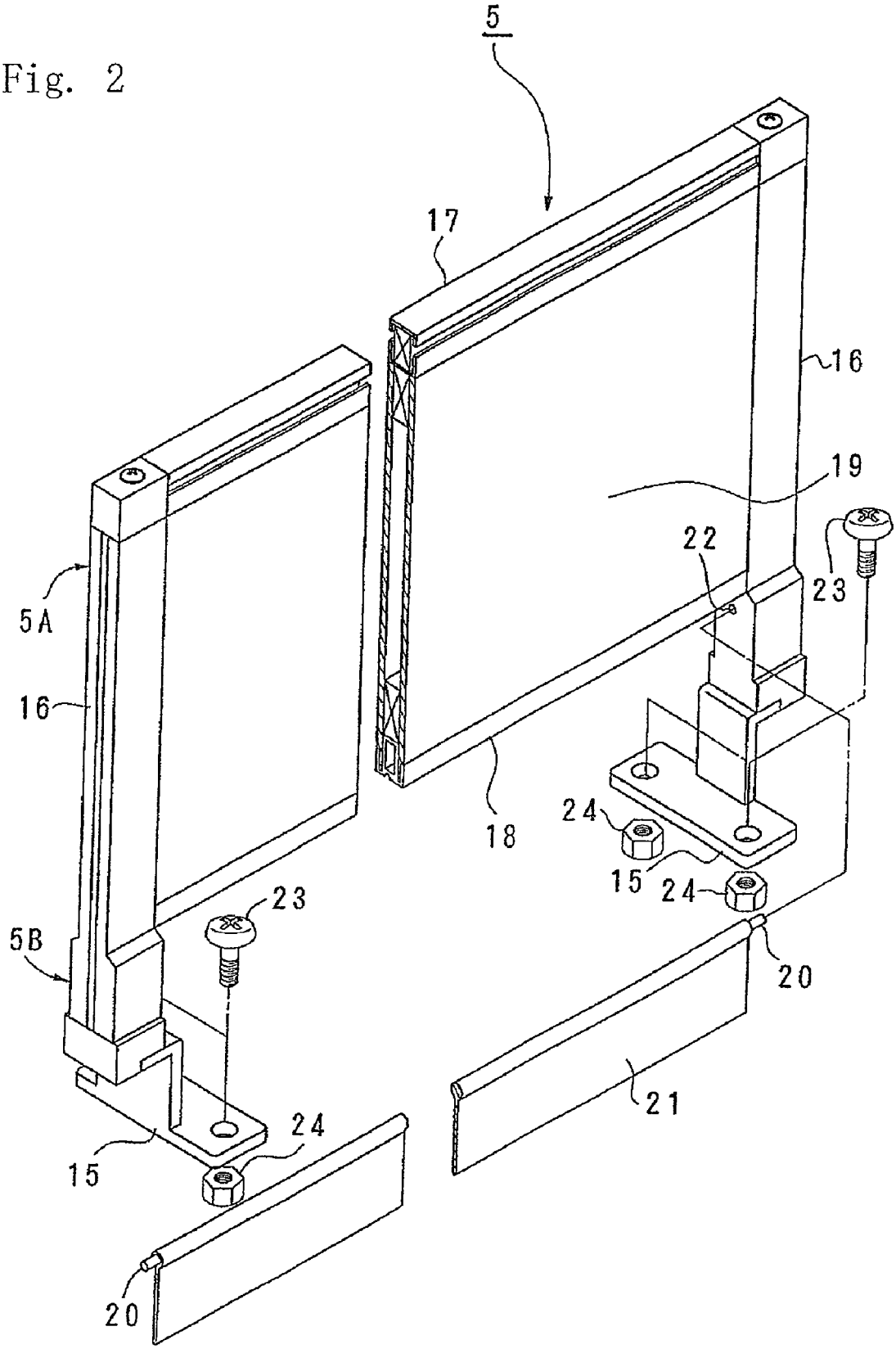
FIG. 2 is an exploded perspective view showing an intermediate part of the desk top panel.
Figure 3:
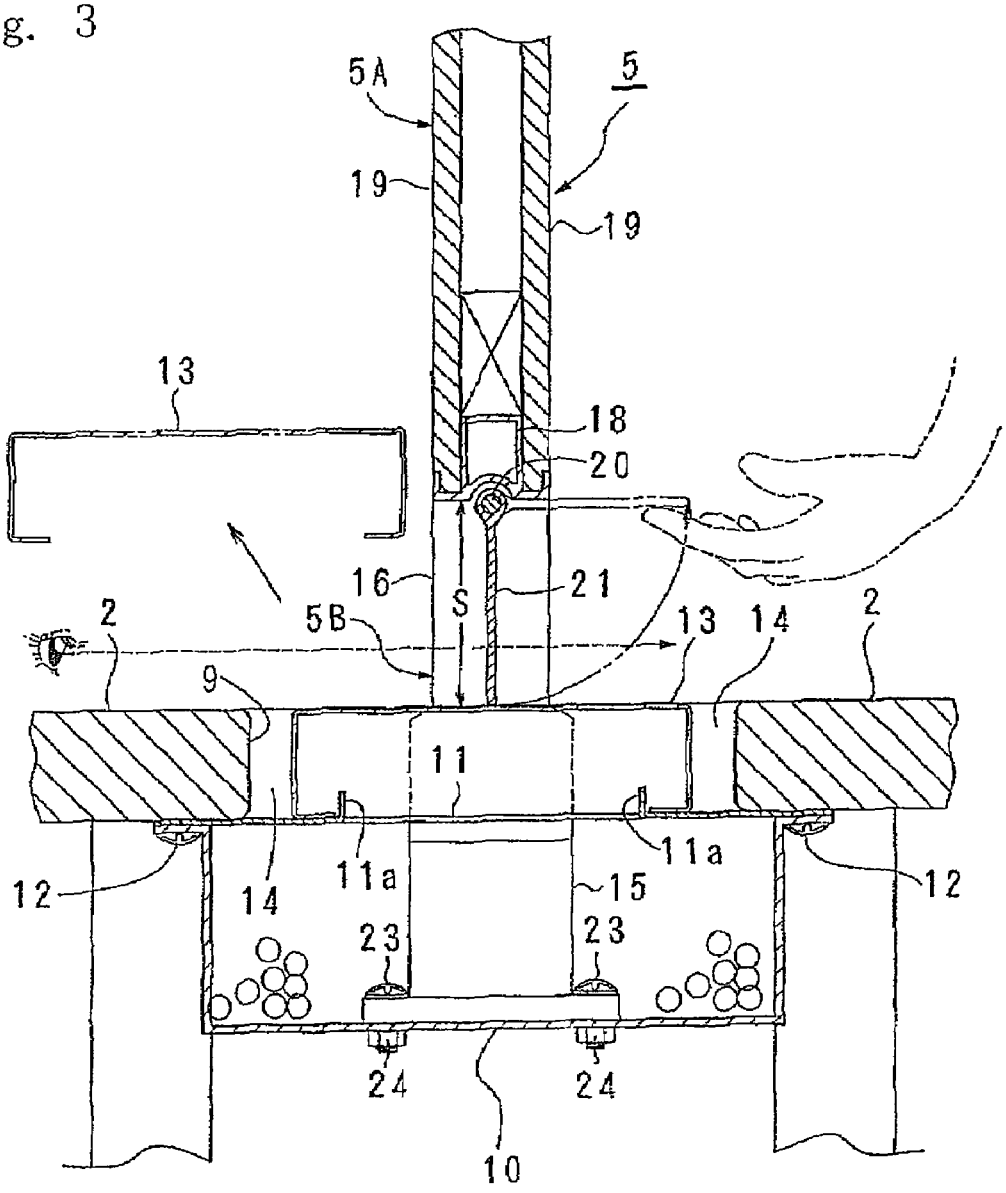
FIG. 3 is an enlarged vertical sectional side view thereof.

FIGS. 1-3 show the first embodiment of the invention.

In FIG. 1, a desk 1 comprises four top boards 2 in which the two boards face each other, while the two boards are arranged side by side. The top boards 2 are supported by a top support A comprising a pair of side panels 3,3; intermediate legs 4 therebetween; and a beam (not shown) for connecting the intermediate legs 4. The desk 1 is a face-to-face type.

Between the top boards 2 and 2, there is provided a desk top panel 5 for blocking front visibility of sitting persons on a chair 6, shown by two-dot-dash lines in front of each of the top boards 2.

Under each of the top boards 2, there is a side wagon 7 as shown by two-dot-dash lines beside the chair 6. On the upper surface of the top board 2, there are a notebook computer 8 in two-dot-dash lines and other electric appliance (not shown). A power source code and a connecting cable pass through an elongate opening 9 between the top boards 2 and 2 under the desk top panel 5 and is stored in a wire duct 10 in FIG. 3.

In FIG. 3, the wire duct 10 comprises a long U-shape and the side edge thereof is fixed on the lower surface of the facing top boards 2,2 with a plurality of support plates 11 with a screw 12.

The opening 9 is closed with a detachable wire cover 13.

The wire cover 13 is formed by bending the edges of a horizontal steel plate into a U-shape and located on the middle of the support plate 11 while a gap 14 through which a wire passes still remains, such that the middle of the opening 9 is coplanar with the upper surface of the top board 2.

In the middle of the support plate 11, a pair of upward projections 11*a*. 11*a* is provided to place the wire cover 13 in the middle.

In FIGS. 2 and 3, the desk top panel 5 comprises a pair of vertical frames 16,16 having a mounting base 15 at the lower end; an upper horizontal frame 9 connecting the upper ends of the vertical frames 16,16; a lower horizontal frame 18 connecting parts close to the lower ends of the vertical frame 18; a pair of rectangular decoration panels 19,19 surrounded by the frames 16,17,18; and a closing member 21 the upper end of which is pivotally mounted to the vertical frames 16,16 on a shaft 20 under the lower horizontal frame 18.

A body 5A of the desk top panel 5 comprises the vertical frames 16,16 higher than the lower horizontal frame 18; the lower horizontal frame 18; and the decoration panels 19,19. A pair of mounting portions 5B comprises the vertical frames 16,16 lower than the lower horizontal frame 18; and the mounting bases 15,15. The mounting portion 5B which suspends from the lower end of the body 5A is mounted at the lower end to the top board 2 or top board support A.

In this embodiment, the shaft 20 passes through the upper part of the closing member 21 and projects at the end which rotatably fits in a bearing hole 22 in the inner surfaces of the vertical frame 16,16.

The mounting bases 15,15 of the mounting portion 5B is disposed on the upper surface of the bottom of the wire duct 10 through the opening 9 and mounted with a bolt 23 and a nut 24. Thus, the desk top panel 5 is firmly fixed to the top board support A.

The mounting bases 15,15 may be directly fixed to the side panel 3, intermediate leg 4 or other member of the top board support A. Particularly, in a desk comprising a single top board, mounting bases 15,15 may be fixed to the upper surface of the top board.

The closing member 21 may be made in proper size to close a space S between the lower end of the body 5A and the upper surface of the top board 2 of the desk 1 when the desk top panel 5 is mounted to the top board support A as above.

As shown by sold lines in FIG. 3, the closing member 21 is normally positioned in a close position by its own weight and closes the space S almost perfectly. The front visibility of the person sitting on the chair 6 is blocked almost perfectly, so that privacy can be protected.

From this position, the person pushes the closing member with a finger forward or backward. As shown by two-dot-dash lines in FIG. 3, the closing member 21 turns to an open position around the shaft 20 to produce the space S to allow one at one side to look at the other at the other side of the desk top panel 5. The space S also enables one to give a document to the other.

The wire cover 13 can be removed from a opening-closing position while the closing member 21 is held in an open position.

The wire cover 13 is removed from the opening 9 to make the opening 9 greater, allowing wires to be stored or removed more easily.

Figure 4:
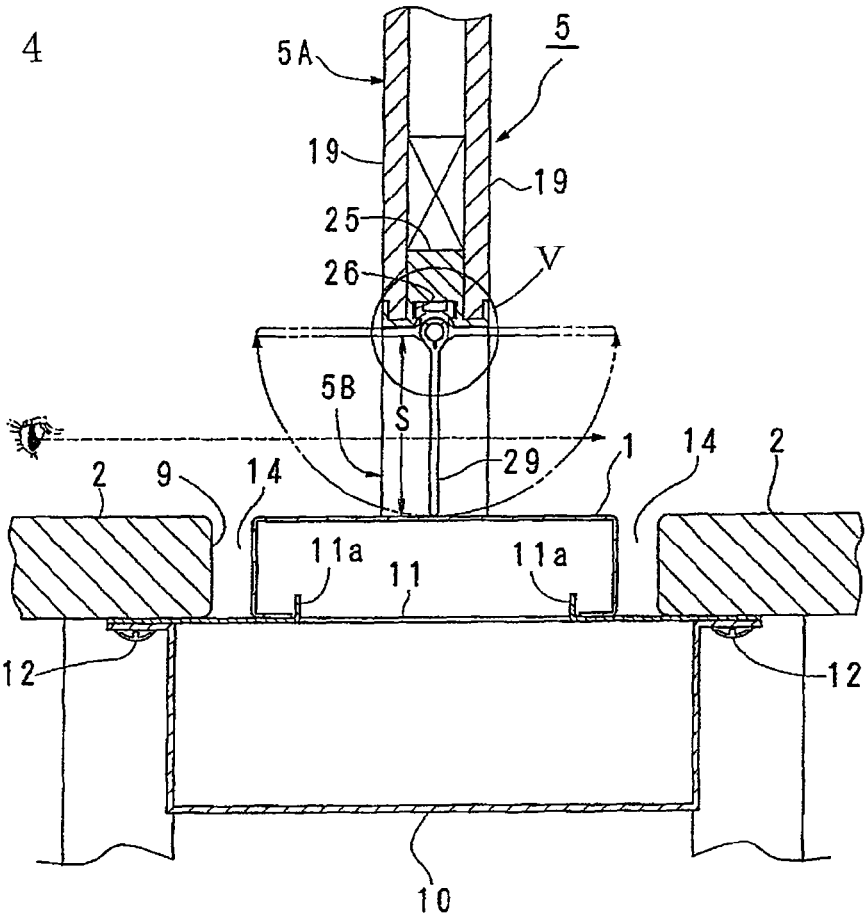
FIG. 4 is an enlarged vertical sectional side view showing a desk with the second embodiment of a desk top panel according to the present invention.

FIGS. 4-6 show the second embodiment of the invention. The same numerals are allotted to the same members as the foregoing embodiment, and detailed description thereof is omitted.

In FIG. 4, an engagement groove 26 is formed at the lower part of a lower horizontal frame 25. In FIG. 6, a plurality of shaft-support blocks 27 engage in the engagement groove 26 at regular intervals. The shaft-support block 27 has a lower semicircular section. In the lower part and sides of the outer circumference of the semicircular section, positioning elastic engagement projections 28 are provided, and a shaft 30 projects from the sides of the shaft-support block 27 at the center of the semicircular section, and the closing member 29 turns with the shaft 30. The shaft 30 may be integrally formed with the shaft-support block 27.

A closing member 29 is molded of synthetic resin and has a pair of arc-like elastically deformable shaft-holding portions 29*a*,29*a* at the upper end. In the middle of the upper end of the closing member 29, there is formed a groove 31 for improving elastic flexibility of the shaft-holding portions 29*a*,29*a*. An elastic engagement projection of the shaft-support block 27 fits in the groove 31.

Figure 5A:
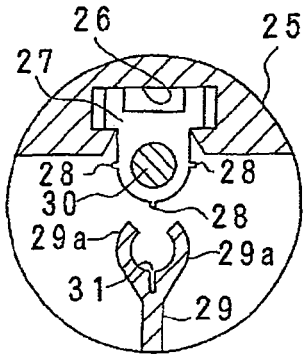
FIGS. 5A-5C are enlarged sectional views of the part V in FIG. 4.
Figure 5B:
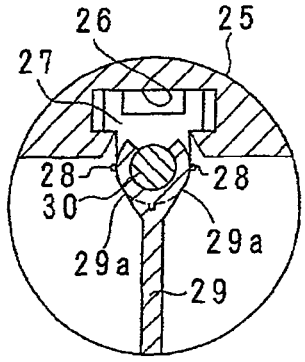
Figure 5C:
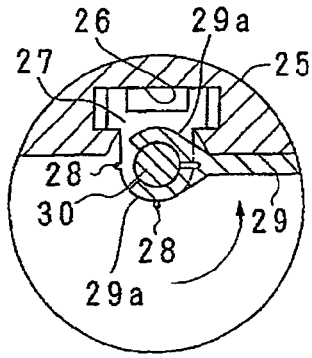
Figure 6A:
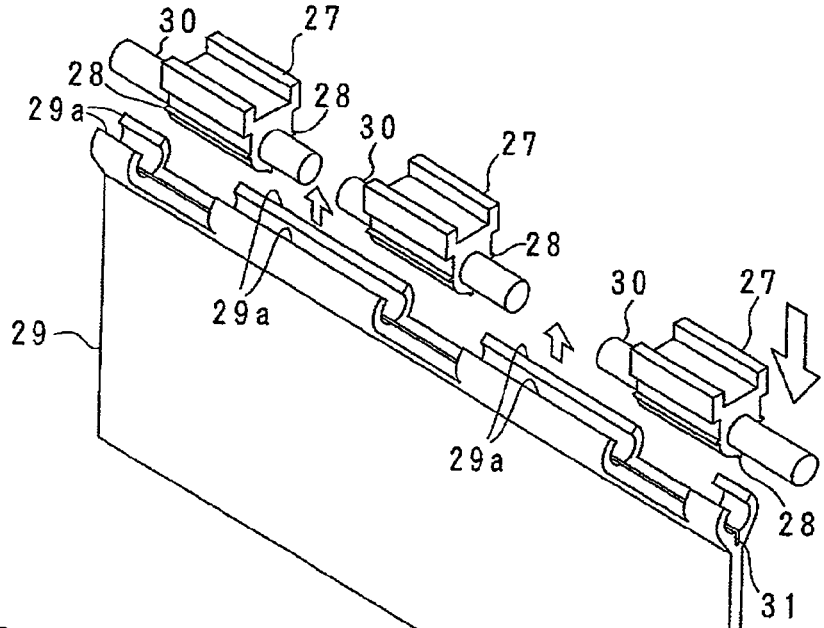
FIGS. 6A and 6B are perspective views showing the steps for assembling a closing member.
Figure 6B:
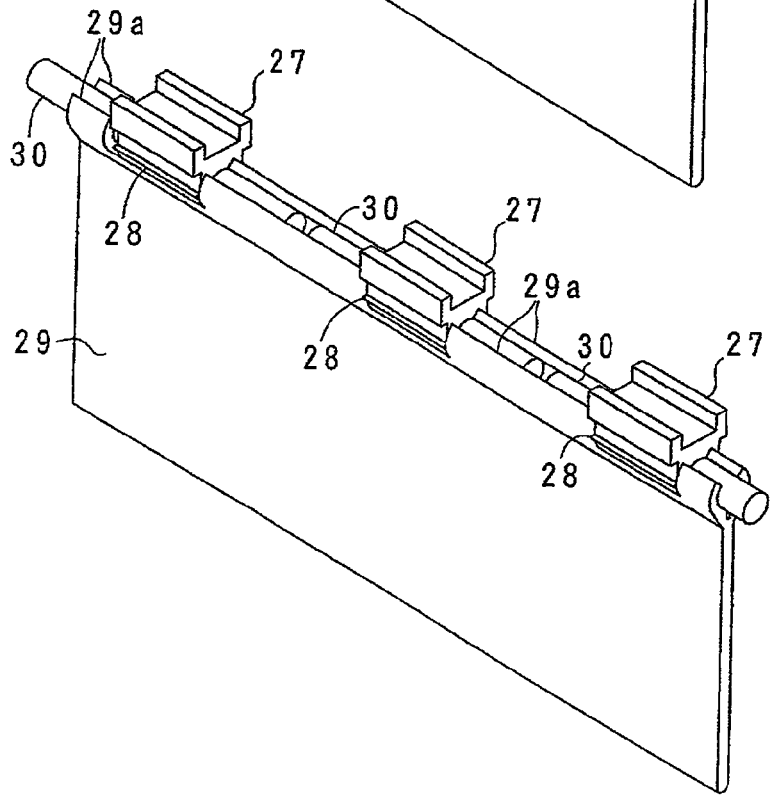

To the shaft support blocks 27 mounted to the lower end of the lower horizontal frame 25 in FIG. 6A, the closing member 29 is pressed up in FIGS. 6A and 5A. In FIGS. 5B and 6B, the shaft 30 is held by the shaft-holding portions 29*a* at the ends projecting from the shaft-support block 27. The elastic engagement projection 28 at the lower end of the shaft-support block 27 fits in the groove 31.

The closing member 29 is stably held in a closed position by engagement of the elastic engagement projection 28 in the groove 31.

Then, the closing member 29 turns forward or backward around the shaft 30. For example, in FIG. 5C, in the backward open position, the groove 31 engages with the elastic engagement projection 28 at the rear surface of the shaft-support block 27 to allow the closing member 29 to be held stably in the open position.

The wires can be taken in and out of the opening 9 easily.

In this embodiment, the closing member 29 is stably held in the closed and open positions by holding means comprising the groove 31 and the three elastic engagement projections 28. Accordingly, the closing member 29 need not to be held with a hand in the open position and does not swing to the closed position.

Figure 7:
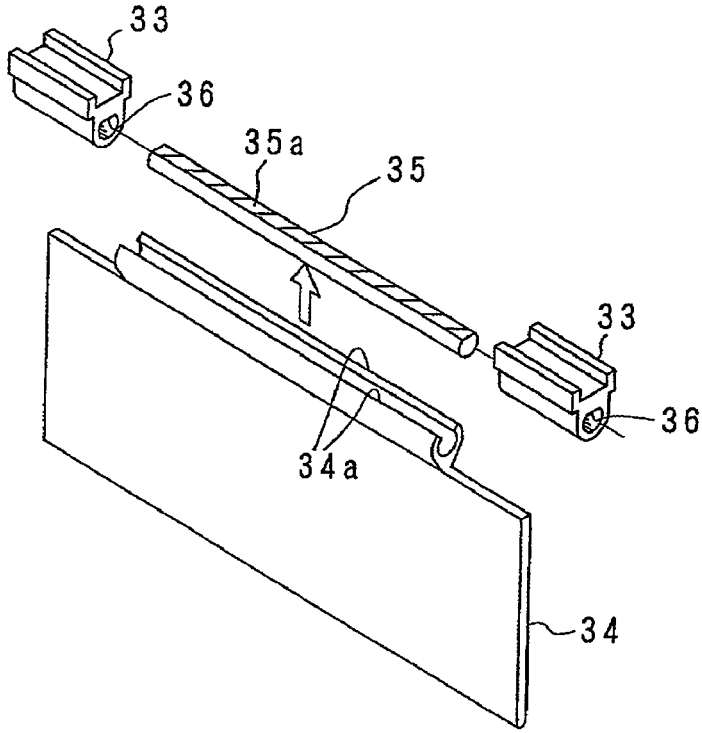
FIG. 7 is an exploded perspective view of the main part in the third embodiment of the present invention.

The third embodiment of the invention is shown in FIGS. 7 and 8.

In the embodiment, a pair of shaft support blocks 33 is fixed to the sides of the lower end of a lower horizontal frame 32, and each end of a shaft 35 around which the closing member 34 turns is pressed and fitted in the shaft support block 33. An upper flat surface 35*a* is formed on the shaft 35 and is corresponding in shape to an engagement hole 36 in the shaft-support block 31.

Figures 8A, 8B, 8C:
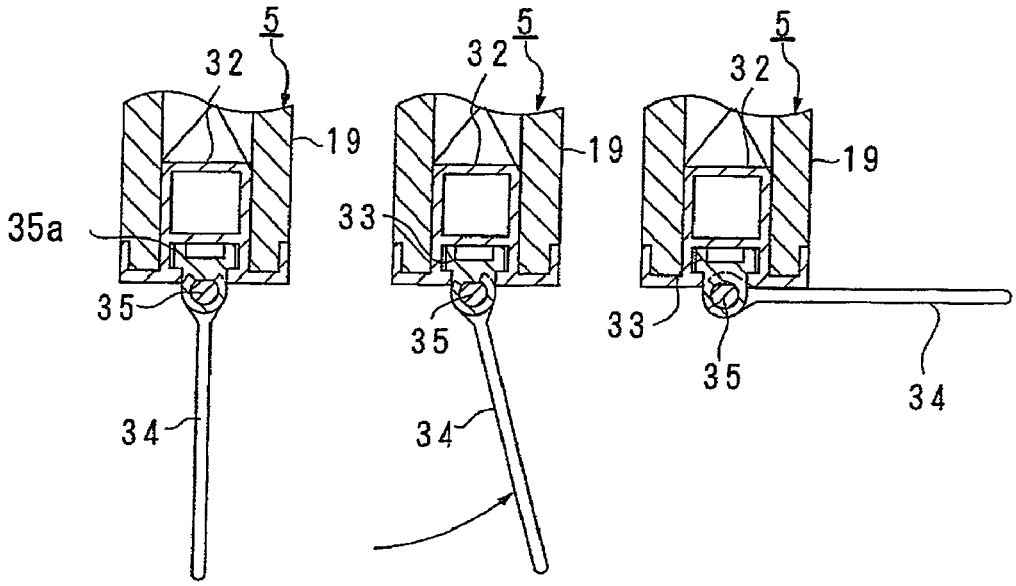
FIGS. 8A-8C are views showing a motion thereof.

The closing member 34 comprises a pair of elastically deformable shaft-holding portions 34*a*,34*a* similar to the second embodiment. The distance between the shaft-holding portions 34*a* and 34*a* is smaller than an external diameter of the shaft 35. In FIG. 8A, when the closing member 34 is in the closed position, the shaft-holding portions 34*a*,34*a* expands at largest, and the side edge of the flat surface 35*a* of the shaft 35 is held by the shaft-holding portions 34*a*,34*a* stably in the closed position. In FIG. 8C from FIG. 8B, when the closing member 34 turns to the open position, the shaft 35 is held while one of the shaft-support portions 34*a* is placed on the flat portion of the shaft 35, so that the closing member 34 is stably held.

In the third embodiment, similar function and advantages to the second embodiment can be achieved.

Figure 9A:
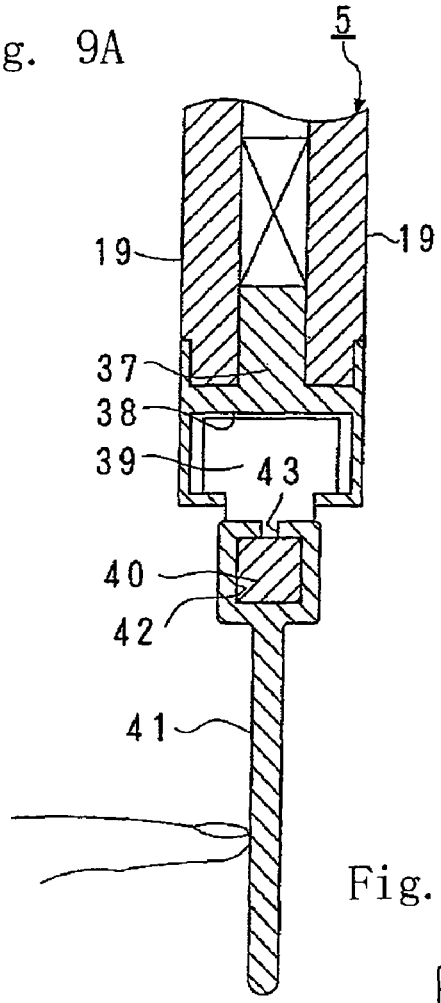
FIGS. 9A-9C are views showing a motion in the fourth embodiment.

FIG. 9 shows the fourth embodiment of the invention. In FIG. 9A, a shaft-support block 39 engages in an engagement groove 38 and has a rectangular-sectioned shaft 40 therefrom.

At the upper end of the closing member 41, an axial hole 42 which fits the shaft 40 is formed and a gap 43 communicates with the axial hole 42.

In FIG. 9A, when the closing member 41 is in the closed position, the inner surface of the axial hole 42 in the closing member 41 tightly contacts the outer circumference of the shaft 40, so that the closing member 41 is stably held.

Figure 9B:
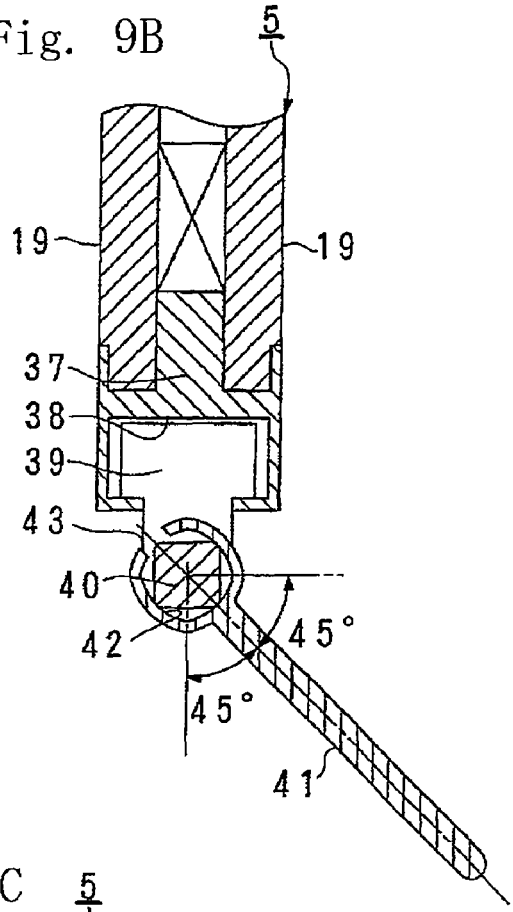
Figure 9C:
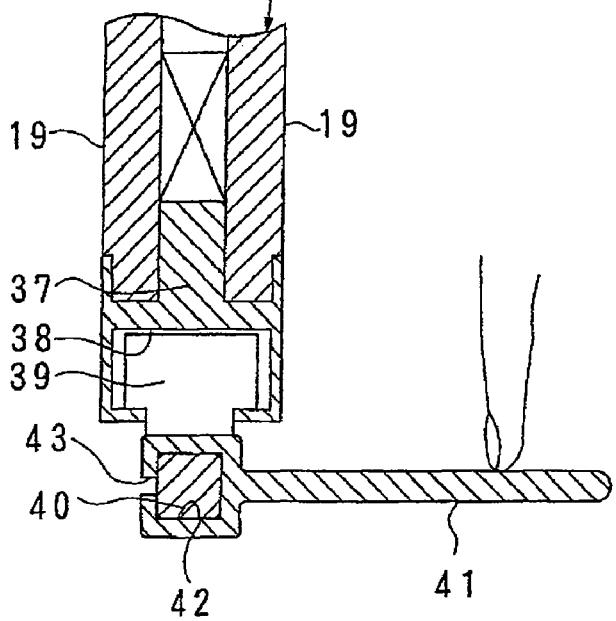

The closing member 41 is pressed rearward and turned around the shaft 40. In FIG. 9B, at a turning angle for 45 degrees from the closed position, the axial hole 42 and its outer circumference at the upper end of the closing member 41 are elastically deformed to expand at largest. Besides the angle, elastic deformation of the axial hole 42 and its circumference gradually decreases. When the closing member 41 reaches an open position in FIG. 9C, the inner surface of the axial hole 42 tightly contacts the outer circumferential surface of the shaft 40, so that the closing member 41 is stably held.

The fourth embodiment achieves function and advantages similar to the second and third embodiments. The closing member 41 can be forced so as to reverse a turning direction at the intermediate position between the closed position and open position.

The shaft 40 and axial hole 42 may be provided in the closing member 41 and shaft-support block 39 respectively.

The shaft 40 and axial hole 42 may be like a polygon such as a hexagon to allow the closing member 41 to be held stably.

Figure 10:
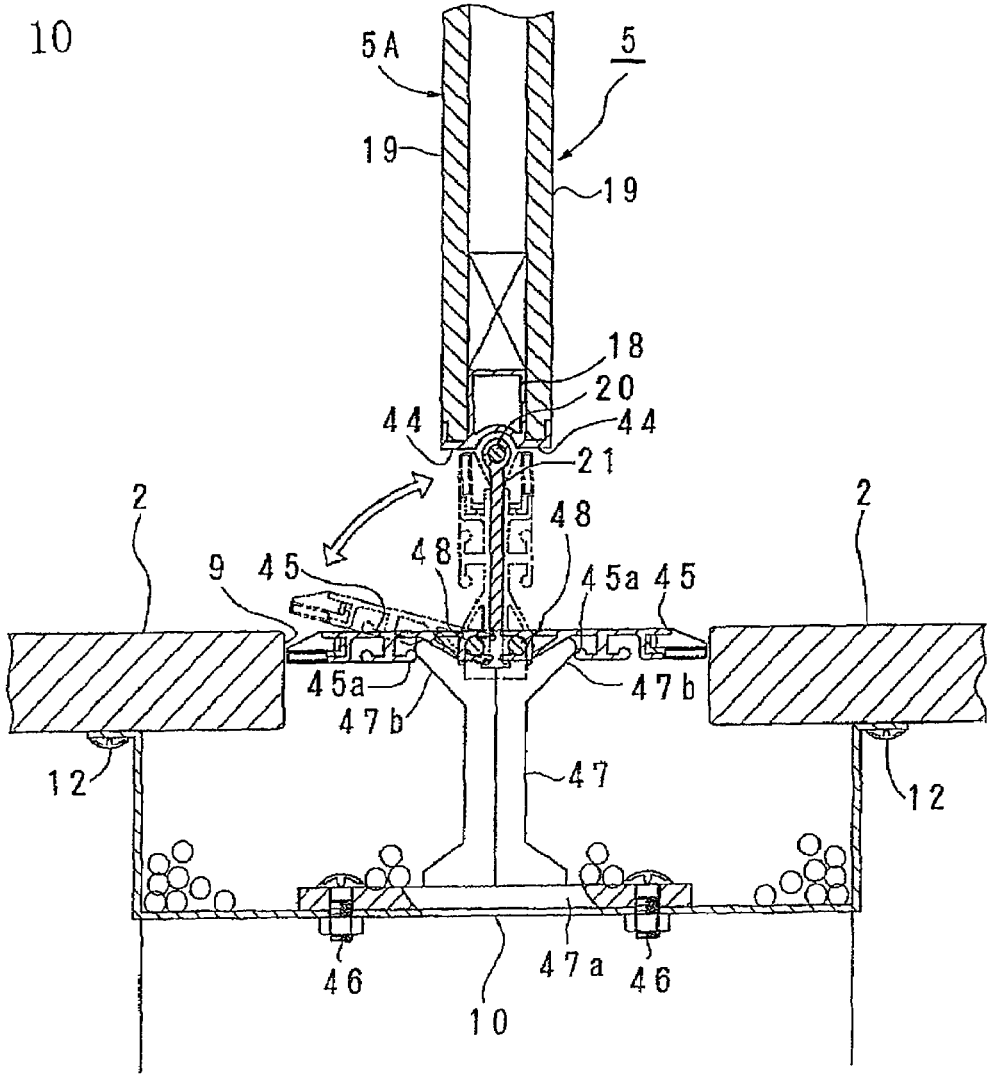
FIG. 10 is a vertical sectional side view of the fifth embodiment of the present invention.

FIG. 10 shows the fifth embodiment of the invention.

In the embodiment, similar to the first embodiment, the upper end of a closing member 21 is pivotally mounted to vertical frames 16,16 on a shaft 20. The closing member 21 is pivotally mounted to the vertical frames 16,16 on a shaft 20. The closing member 21 is thinner than a lower horizontal frame 18. The closing member 21 is disposed in the middle of the lower horizontal frame 18. When the closing member 21 is in a closed position, there are recesses 44,44 in front of and behind the closing member 21 under a body 5A of a desk top panel 5. Swaying wire cover 45,45 for an opening 9 turns upward to allow the wire cover 45 to be stored into the recesses 44 when the opening 9 is open.

A plurality of cover supports 47 is arranged at regular intervals and has mounting portion 47*a* at the lower end fixed with a bolt and a nut 46 to the bottom of the wire duct 10. The wire covers 45,45 are pivotally mounted to the upper end of the cover supports 47 on pivot shafts 48,48 and turns with the pivot shaft 48 between a horizontal closed position coplanar with a top board 2 as shown by solid lines in FIG. 10 and an open position as shown by two-dot-dash lines.

On the lower side of the wire cover 45, there is provided an engagement projection 45*a* which elastically engages with an engagement portion 47*b* extending from the upper end of the cover support 47. When the wire cover 45 turns from the open position to the closed position, the engagement projection 45*a* elastically engages with the engagement portion 47*b* to allow the wire cover 45 to be elastically held in the closed position.

The wire cover 45 turns upward to the open position. When the opening 9 is open, each of the wire covers 45 is stored in the recess 44, allowing the opening 9 to open larger to facilitate wires to be taken in and out of the wire duct 10.

The opening 9 can be provided close to the desk top panel 5, thereby providing broader working space on the top board 2.

Figure 11:
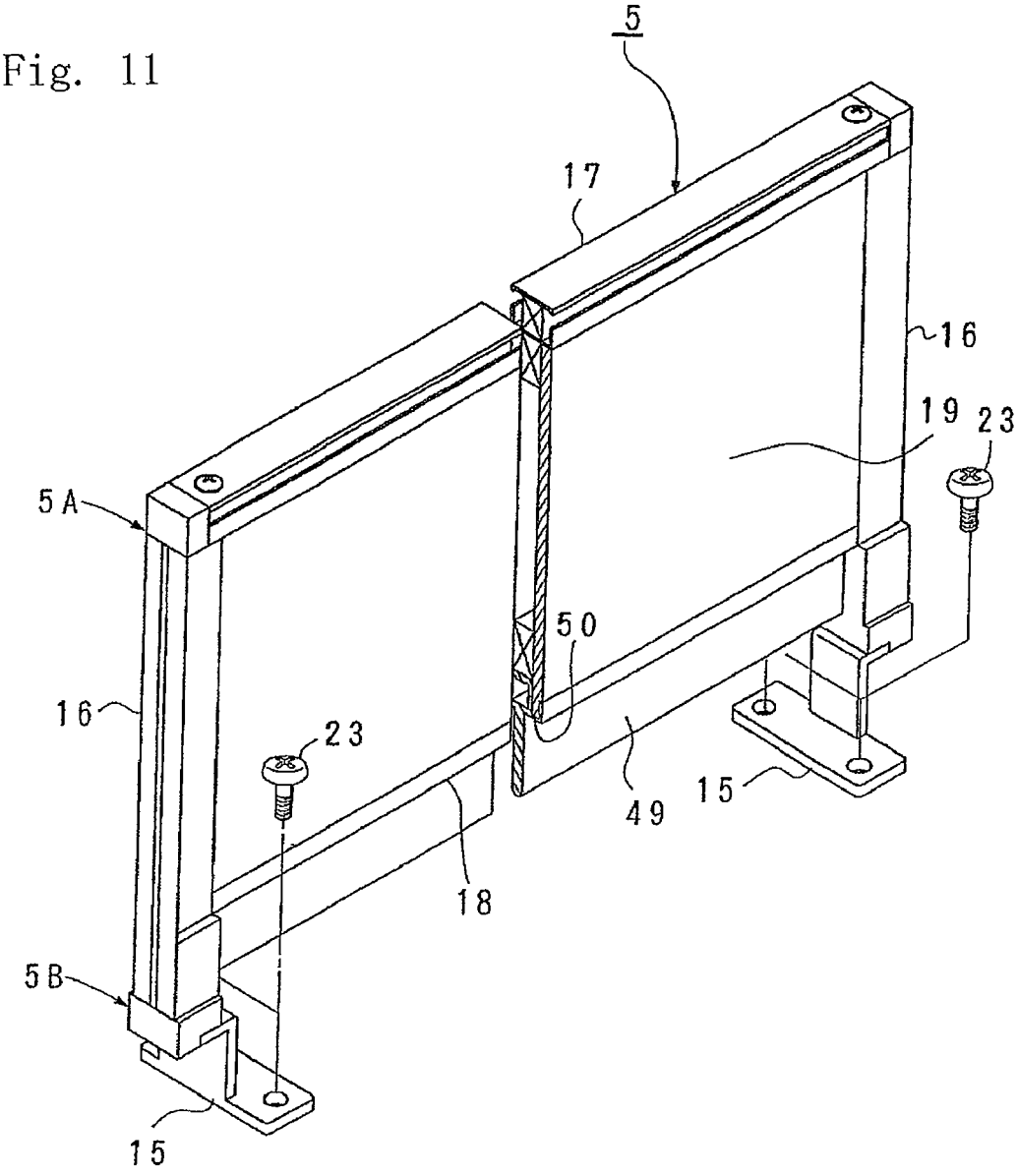
FIG. 11 is an exploded perspective view of the sixth embodiment of a desk top panel according to the present invention.
Figure 12:
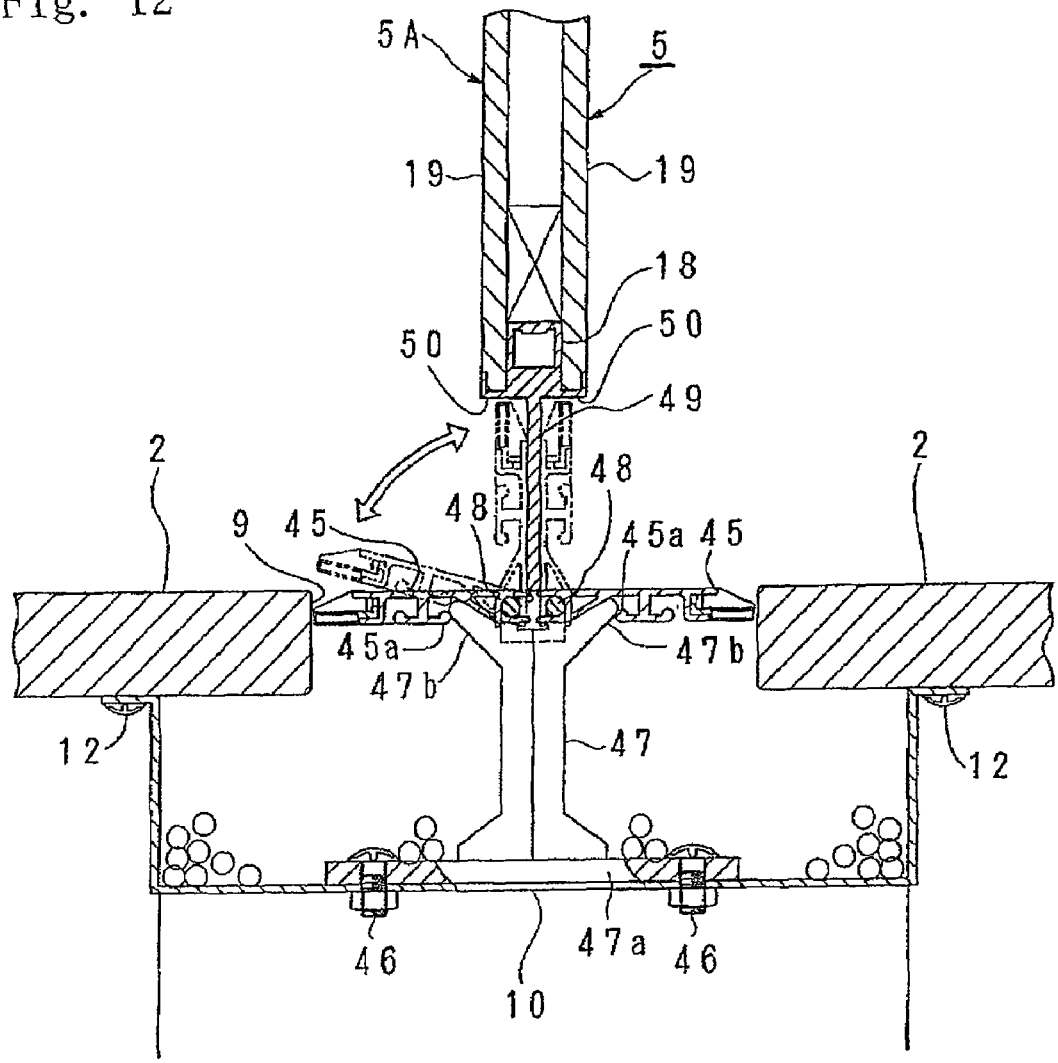
FIG. 12 is a vertical sectional side view thereof.

The sixth embodiment is shown in FIGS. 11 and 12.

In the embodiment, wire covers 45,45 have the same structure as those in the fifth embodiment. There is provided a suspension 49 thinner than the lower horizontal frame 18 at the lower end of a body 5A of a desk top panel 5 or in the middle of the lower surface of a lower horizontal frame 18. There are grooves 50,50 on the lower end of the desk top panel 5, When the wire covers 45,45 turns upward to open an opening 9, the wire covers 45 are stored in the grooves 50,50.

Each of the wire covers 45 turns to an open position to make the opening 9 broader, allowing wires to be taken in and out of a wire duct 10 easily. The opening 9 can become close to the desk top panel 5, making working space on a top board broader.

The present invention is not limited to the foregoing embodiments, but variations may be made without departing from the scope of claims.

For example, in the foregoing embodiments, the desk 1 comprises face-to-face connected desks, but the present invention can apply to a single top board desk.

In this case, the desk top panel 5 may be mounted not only to the top board support A but also to the top board 2 directly. The opening 2 may comprise an elongate hole at the rear part of the top board 2 or may be cut away forward from the rear end of the top board 2.

What is claimed is:

1. A desk top panel mounted upright on a rear end of a top board of a desk to block visibility of a person sitting at the desk, the desk top panel comprising:

a panel-like body having a first side and a second side on an opposite side from the first side and having a lower end including a lower side end, the panel-like body mounted to the top board of the desk so as to create a vertical space between the panel-like body and the top board;

a pair of mounting portions each mounting portion suspended from the lower side end of the panel-like body and configured to support the panel-like body;

a shaft pivotally mounted at the lower end of the panel-like body; and a closing member that is pivotally mounted to the shaft and, the closing member configured and positioned to turn about the shaft forward by being pushed from the first side and backward by being pushed from the second side so as to open the space.

2. The desk top panel of claim 1, wherein the closing member turns between a closed position in which the space is closed and an open position in which the space is open.

3. The desk top panel of claim 2 wherein the body of the desk top panel comprises an elastic engagement projection, the closing member having a groove, the elastic engagement projection engaging in the groove when the closing member is in the closed or open position, thereby holding the closing member.

4. A desk comprising:

a desk top panel mounted upright on a rear end of a top board of the desk to block visibility of a person sitting at the desk, the desk top panel comprising:

a panel-like body having a first side and a second side opposite from the first side and having a lower end including a side end, a pair of mounting portions, each mounting portion suspend from the lower side end of the body, a shaft mounted at the lower end of the panel-like body, and a closing member that is pivotally mounted to the and is configured and positioned to turn about the shaft forward by being pushed from the first side and backward by being pushed from the second side to open and close a space between the body and the top board of the desk;

an opening positioned under the closing member;

a wire cover configured to cover the opening when in the closed position and to reveal the opening in the open position; and a wire passing through the opening.

5. The desk of claim 4 wherein the opening is formed between the top board and top board support.

6. A desk comprising:

a top board;

a top board support supporting the top board to form an opening between the top board and the top board support;

a desk top panel mounted upright on a rear end of the top board of the desk to block visibility of a person sitting at the desk, the desk top panel comprising:

a panel-like body having a first side and a second side opposite from the first side and having a lower end including a lower side end, a pair of mounting portions each mounting portion suspended from the lower side end of the body, a shaft mounted at the lower end of the panel-like body, and a closing member that is pivotally mounted to the shaft and is configured and positioned to turn about the shaft forward by being pushed from the first side and backward by being pushed from the second side to open and close a space between the body and the top board of the desk, a recess being formed under the desk top panel; and a wire cover that is pivotally mounted on a pivot shaft to the top board or the top board support to cover the opening, the wire cover turning upward and being stored in the recess under the desk top panel.

7. The desk of claim 6, further comprising a cover support under the desk top panel, the wire cover being pivotally mounted to the cover support.

8. A desk comprising:

a top board;

a top board support supporting the top board;

a desk top panel mounted upright on a rear end of the top board, a recess being formed under the desk top panel; and a wire cover pivotally mounted to the top board or the top board support and covering an opening that stores a wire, the wire cover turning upward and being stored in the recess under the desk top panel.

9. The desk of claim 8, further comprising a cover support under the desk top panel, the wire cover being pivotally mounted to the cover support.

10. A face-to-face-type desk comprising:

a pair of top boards that faces each other, an opening being formed between the top boards, a wire passing through the opening;

a pair of top board supports each supporting each of the pair of top boards;

a desk top panel provided between the pair of top boards, a recess being formed under the desk top panel; and a pair of wire covers pivotally mounted to the top board or the top board support, the wire covers turning upward and being stored in the recess under the desk top panel.

11. The desk of claim 10, further comprising a cover support under the desk top panel, the wire cover being pivotally mounted to the covers support.

* * * * *